US012753988B2

(12) United States Patent
Cheng

(10) Patent No.: US 12,753,988 B2
(45) Date of Patent: Oct. 6, 2026

(54) SAFETY LOCKING MECHANISM FOR ELASTICALLY EXPANDABLE BATON

(71) Applicant: Kantas Products Co., Ltd., Taipei City (TW)

(72) Inventor: Yang-Fu Cheng, Taipei City (TW)

(73) Assignee: Kantas Products Co., Ltd., Taipei City (TW)

( * ) Notice: Subject to any disclaimer, the term of this patent is extended or adjusted under 35 U.S.C. 154(b) by 195 days.

(21) Appl. No.: 18/827,644

(22) Filed: Sep. 6, 2024

(65) Prior Publication Data

US 2025/0137747 A1 May 1, 2025

(30) Foreign Application Priority Data

Oct. 30, 2023 (TW) ..... 112211722

(51) Int. Cl.
*F41B 15/02* (2006.01)

(52) U.S. Cl.
CPC ..... *F41B 15/027* (2013.01)

(58) Field of Classification Search
None
See application file for complete search history.

(56) References Cited

U.S. PATENT DOCUMENTS 4,037,839 A * 7/1977 Nelson ..... F41B 15/027 463/47.7
4,456,255 A * 6/1984 Braunhut ..... F41B 15/025 463/47.7
5,031,827 A * 7/1991 von Braunhut ..... F41B 15/027 463/47.7
5,356,139 A * 10/1994 Parsons ..... F41B 15/025 463/47.7
5,372,363 A * 12/1994 Siddle ..... F41B 15/025 463/47.7
5,568,922 A * 10/1996 Siddle ..... F41B 15/022 463/47.7
5,657,986 A * 8/1997 Parsons ..... F41B 15/025 463/47.7
5,690,552 A * 11/1997 Siddle ..... F41B 15/025 463/47.7
D404,789 S * 1/1999 Starrett ..... D22/117
H1947 H * 3/2001 Starrett ..... 463/47.7
D440,273 S * 4/2001 Hindi ..... F41B 15/022 D22/117
6,231,447 B1 * 5/2001 Pelkey ..... F41B 15/027 403/368

(Continued)

FOREIGN PATENT DOCUMENTS

WO WO-2020060899 A1 * 3/2020 ..... F41B 15/027

*Primary Examiner* — Paul A D'Agostino

(57) ABSTRACT

A safety locking mechanism is applicable to an elastically expandable baton including a plurality of hollow tubes that can be collapsed into a short baton or expanded into a long baton. The safety locking mechanism includes a positioning portion that can be fixed to one of the hollow tubes, a locking-releasing button pivotally connectable to the positioning portion, and a safety locking key arranged to the locking-releasing button. A user only needs to push the safety locking key with a finger and makes the safety locking key to be in a locking position, the locking-releasing button will not be able to move as a lever, thereby keeping the elastically expandable baton in the short-baton state.

9 Claims, 11 Drawing Sheets

(56) References Cited

U.S. PATENT DOCUMENTS 6,238,292 B1 * 5/2001 Pelkey ..... F41B 15/027 403/368
D452,545 S * 12/2001 Starrett ..... F41B 15/025 D22/117
7,044,858 B1 * 5/2006 Otto ..... F41B 15/022 463/47.7
8,771,085 B1 * 7/2014 Clyde ..... G06F 1/1696 463/47.4
11,067,359 B1 * 7/2021 Chiang ..... F41B 15/027
2003/0165042 A1 * 9/2003 Stethem ..... F21V 33/0076 361/232
2003/0229988 A1 * 12/2003 Jennings ..... B26B 29/02 30/2
2005/0083679 A1 * 4/2005 Macierowski ..... F41B 15/027 362/102
2007/0026950 A1 * 2/2007 Otto ..... F41B 15/025 463/47.7
2007/0042825 A1 * 2/2007 Jung ..... F41B 15/025 463/47.7
2012/0129613 A1 * 5/2012 Milligan ..... F41B 15/025 463/47.7
2013/0150167 A1 * 6/2013 Pelkey ..... F41B 15/027 463/47.7
2014/0142600 A1 * 5/2014 Kumar ..... A61B 17/3213 606/167
2014/0194212 A1 * 7/2014 Walter ..... F41B 15/027 463/47.7
2014/0256452 A1 * 9/2014 Cheng ..... F41B 15/027 463/47.7
2014/0256453 A1 * 9/2014 Pelkey ..... F41B 15/027 463/47.7
2014/0357382 A1 * 12/2014 Quail ..... F41B 15/025 463/47.7
2016/0169616 A1 * 6/2016 Cheng ..... F41B 15/00 463/47.7
2017/0226776 A1 * 8/2017 Nicoara ..... E05B 15/102
2018/0066915 A1 * 3/2018 Cheng ..... F41B 15/022
2018/0274880 A1 * 9/2018 Tanzini ..... F41B 15/022
2018/0361177 A1 * 12/2018 Lee ..... F41B 15/022
2018/0361178 A1 * 12/2018 Cheng ..... F41B 15/025
2019/0184584 A1 * 6/2019 Duey ..... B25F 1/04
2020/0158462 A1 * 5/2020 Kupa ..... F41B 15/027

* cited by examiner

SAFETY LOCKING MECHANISM FOR ELASTICALLY EXPANDABLE BATON

CROSS-REFERENCE TO RELATED PATENT APPLICATION

This non-provisional application claims priority to and the benefit of, under 35 U.S.C. § 119 (a), Taiwan Patent Application No. 112211722, filed Oct. 30, 2023 in Taiwan. The entire content of the above identified application is incorporated herein by reference.

FIELD

The present disclosure is related to a safety locking mechanism for an elastically expandable baton, and particularly to a safety locking mechanism arranged on an elastically expandable baton and keeping a locking-releasing button in a locked state and from being pressed and operated, so that the elastically expandable baton can be stably kept in a short-baton state.

BACKGROUND

It is common practice for police officers and security guards to carry a self-defense baton with them in order to effectively deter criminals and protect people's lives, homes, and properties as well as the lives of the baton users themselves. In a society where public safety leaves much to be desired, ordinary people may also carry a baton with them in case self-defense is necessary. To meet such demands for batons, manufacturers have, since long ago, developed and designed various types of expandable batons to enable ease of wearing and carrying, to enhance the convenience and safety of use and operation, and to avoid unnecessary suspicion and trouble arising from wearing or carrying such a self-defense device. Currently, a commercially available expandable baton is typically composed of a plurality of tubes and can be generally categorized according to its structural composition and functional features as falling into one of the following two kinds. The first kind is the swinging-type expandable baton disclosed in U.S. Patent Application Publication No. 20130150167. Referring to FIG. 1, the swinging-type expandable baton 1 is assembled from an outer tube 11, a middle tube 12, and an inner tube 13. All the tubes 11, 12, and 13 are configured as hollow tubes. The inner diameter of the outer tube 11 is greater than the outer diameter of the middle tube 12, and the inner diameter of the middle tube 12 is greater than the outer dimeter of the inner tube 13, in order for the inner tube 13 to be retractable into the middle tube 12, and for the middle tube 12 to be retractable into the outer tube 11. When a user firmly holding the outer tube 11 of the swinging-type expandable baton 1 swings the baton forcibly, the inner tube 13 and the middle tube 12 will extend out of the middle tube 12 and the outer tube 11 respectively at once, and each two adjacent ones of the tubes will engage with each other to form a long expanded baton that can be used to attack an enemy as well as for self-defense. Conversely, when the swinging-type expandable baton 1 is in the long-baton state, and one end of the inner tube 13 is subjected to an externally applied force for collapsing the baton, the inner tube 13 and the middle tube 12 will be sequentially retracted into the middle tube 12 and the outer tube 11 respectively, thereby turning the baton into a short collapsed one that can be easily and safely carried, stored, or worn.

The second kind of expandable batons that are commonly seen on the market is elastically expandable batons. Referring to FIG. 2, the elastically expandable baton 2 is assembled from an impact head 21, an inner tube 22, a middle tube 23, a coil spring 24, a spring mounting rod 25, an outer tube 26, a cap 27, a positioning ring 28, and a locking-releasing button 29. The cap 27 is locked to a first end of the outer tube 26. All the tubes 22, 23, and 26 are configured as hollow tubes. The inner diameter of the outer tube 26 is greater than the outer diameter of the middle tube 23, and the inner diameter of the middle tube 23 is greater than the outer diameter of the inner tube 22, in order for the inner tube 22 to be retractable into the middle tube 23, and for the middle tube 23 to be retractable into the outer tube 26. Thus, the elastically expandable baton 2 can be collapsed into a safe short-baton state to facilitate storage and carry. Conversely, each two adjacent ones of the tubes 22, 23, and 26 of the elastically expandable baton 2 can be extended with respect to, and engage with, each other, thereby bringing the baton into a long-baton state suitable for attacking an enemy as well as for self-defense. One end of the spring mounting rod 25 is fixed to the inner side of the cap 27, the coil spring 24 is mounted around the spring mounting rod 25, and the other end of the spring mounting rod 25 extends into the inner tube 22 through a first end of the inner tube 22 such that the other end of the coil spring 24 presses against the inner side of a second end of the inner tube 22. The impact head 21 is locked to, and located outside, the second end of the inner tube 22. The positioning ring 28 is locked to the outer periphery of the outer tube 26 at a position adjacent to a second end of the outer tube 26 and is configured to position the locking-releasing button 29 on the outer periphery of the outer tube 26 at a position adjacent to the second end of the outer tube 26. Referring to FIG. 3 and FIG. 4, a central portion of the locking-releasing button 29 is pivotally connected to the positioning ring 28 through a pivot shaft 290, and each of the two ends of the locking-releasing button 29 forms one or the other of a locking hook 291 and a release key 292. The locking hook 291 corresponds to the second end of the outer tube 26 so that when the inner tube 22 is completely stored in the outer tube 26, the locking hook 291 can engage precisely with an engaging groove 210 on the periphery of the impact head 21 to keep the elastically expandable baton 2 in the collapsed state, i.e., the safe short-baton state, which allows the baton to be easily carried, stored, or worn. The locking-releasing button 29 further includes a restoring spring 293. The two ends of the restoring spring 293 press against a position on the locking-releasing button 29 that corresponds to the release key 292 and the corresponding position on the outer tube 26, respectively, to ensure that the locking hook 291 stays at a position where the locking hook 291 engages with the engaging groove 210 on the periphery of the impact head 21. Thus, when a user of the elastically expandable baton 2 is faced with an emergency and desires to use the baton, the user can press the release key 292 of the locking-releasing button 29 with a finger (e.g., a thumb) while holding the outer tube 26. The locking-releasing button 29 will be moved like a lever and thereby move the locking hook 291 away from the position where the locking hook 291 engages with the engaging groove 210 on the periphery of the impact head 21, and in consequence, the impact head 21 is released. As the coil spring 24 has stored therein a great elastic force while the elastically expandable baton 2 was in the collapsed, or short-baton, state, and the elastic force acts entirely on the second end of the inner tube 22 or on the impact head 21, the impact head 21 will be displaced outward as soon as it is released, with the inner tube 22 and the middle tube 23 moving along with the impact head 21 and springing out of the outer tube 26. Thus, the elastically expandable baton 2 is instantaneously expanded and becomes a long baton that can be used to attack an enemy as well as for self-defense.

Unlike the conventional swinging-type expandable baton 1, which must be used in a relatively spacious environment so that the user can swing the baton in a normal manner in order to expand the baton instantaneously and thereby turn the baton into a long one suitable for attacking an enemy as well as for self-defense, the conventional elastically expandable baton 2 is not subject to the limitation of space. A user of the elastically expandable baton 2 who is faced with an emergency and desires to use the baton only has to press the release key 292 of the locking-releasing button 29 with a finger (e.g., a thumb or an index finger) while holding the outer tube 26, and the locking-releasing button 29 will be moved like a lever to disengage the locking hook 291 from the engaging groove 210 on the periphery of the impact head 21, thereby releasing the impact head 21. As the coil spring 24 has stored therein a great elastic force while the elastically expandable baton 2 was in the collapsed, or short-baton, state, and the elastic force acts entirely on the second end of the inner tube 22 or on the impact head 21, the impact head 21 will be displaced outward as soon as it is released, with the inner tube 22 and the middle tube 23 moving along with the impact head 21 and springing out of the outer tube 26; as a result, the conventional elastically expandable baton 2 is instantaneously expanded and becomes a long baton that can be used to attack an enemy as well as for self-defense. Moreover, the visual effect of springing out instantaneously and the great impact force and loud impact sound produced by the springing action add to the intimidating effect of the conventional elastically expandable baton 2. This explains why the conventional elastically expandable baton 2 is favored by police officers and security guards on duty and has gradually become the mainstream baton among the police and in the security industry.

However, it has been found that many users have complained unanimously about the following issue about various expandable batons 1 and 2. Referring to FIG. 2 to FIG. 4, although a user may, when not intending to use the conventional elastically expandable baton 2, retract the inner tube 22 and the middle tube 23 into the outer tube 26 for storage and bring the locking hook 291 precisely into engagement with the engaging groove 210 on the periphery of the impact head 21, thereby collapsing the conventional elastically expandable baton 2 into, and maintaining the baton in, the safe short-baton state so that the user can carry or wear the baton easily, the release key 292 of the locking-releasing button 29 of the conventional elastically expandable baton 2 is very likely to be pressed by accident such that the impact head 21 is released by mistake. As the coil spring 24 has stored therein a great elastic force while the conventional elastically expandable baton 2 was in the collapsed, or short-baton, state, and the elastic force acts entirely on the impact head 21, an inadvertent press on the release key 292 of the locking-releasing button 29 will release this great elastic force, which in turn displaces the impact head 21 outward immediately, with the inner tube 22 and the middle tube 23 moving along with the impact head 21 and popping out of the outer tube 26, thereby instantaneously turning the conventional elastically expandable baton 2 into a long baton that can be used to attack an enemy as well as for self-defense. The instantaneous pop-out of the impact head 21 and the great impact force of the inner tube 22 and the middle tube 23, however, can hurt the users themselves or a nearby person or object, which has caused a huge problem to all users. In light of this, one of the issues to be addressed in the present disclosure is how to design a safety locking mechanism for the elastically expandable baton 2, wherein the safety locking mechanism has a safety locking key that can keep the elastically expandable baton 2 in the safe short-baton state, which facilitates storage and carry, not only when the elastically expandable baton 2 is not in use, but also when the release key 292 of the locking-releasing button 29 is inadvertently pressed. Such a safety locking mechanism provided in the present disclosure ensures that the impact head 21, the inner tube 22, and the middle tube 23 of the elastically expandable baton 2 will not spring out and hurt the users themselves or a nearby person or object when the release key 292 of the locking-releasing button 29 is pressed by accident, and that only by pushing the safety locking key with a finger (e.g., when the user is faced with an emergency and desires to use the elastically expandable baton 2) can the locking-releasing button 29 be brought into, and kept in, a ready-to-be-actuated state, in which the release key 292 can be pressed with a finger in order to release the impact head 21 immediately, allowing the impact head 21 to be pushed and displaced outward by the great elastic force stored in the coil spring 24, and allowing the inner tube 22 and the middle tube 23 to move along with the impact head 21 and spring out of the outer tube 26 to thereby instantaneously turn the elastically expandable baton 2 into a long baton that can be used to attack an enemy as well as for self-defense, thereby greatly enhancing the convenience and safety of use and operation of the elastically expandable baton 2.

SUMMARY

In view of the fact that the impact head, the inner tube and the middle tube of a conventional elastically expandable baton in use is extremely prone to popping outward instantaneously because of an inadvertent press on its release key, and that the great impact force of the instantaneous pop-out of the impact head, the inner tube and the middle tube frequently leads to accidents and regrettable incidents in which the user or a nearby person or object is hurt, based on years of practical experience and professional knowledge, as a result of incessant research and testing, and having taken various feasibilities with respect to practical operation into consideration, a safety locking mechanism for an elastically expandable baton is provided in the present disclosure, so as to effectively improve the efficiency in production of the elastically expandable baton and greatly improve the convenience and safety of use and operation of the elastically expandable baton through the safety locking mechanism which is easier to produce and assemble.

Certain aspects of the present disclosure are directed to a safety locking mechanism applicable to an elastically expandable baton. The safety locking mechanism includes a positioning portion, a locking-releasing button and a safety locking key. The positioning portion is configured to be arranged at an outer periphery of an outermost hollow tube of the elastically expandable baton at a position adjacent to a front end of the outermost hollow tube. The locking-releasing button is pivotally connectable to the positioning portion. The locking-releasing button has a locking hook, a slide groove and two ends configured to move as a lever on the positioning portion. The locking-releasing button is configured to: lock an impact head of the elastically expandable baton through the locking hook and keep the elastically expandable baton in a short-baton state; and release the impact head of the elastically expandable baton through a lever movement when being pressed and allow the elastically expandable baton to be expanded into a long-baton state. The safety locking key is mountable to and bidirectionally slidable in the slide groove of the locking-releasing button. The safety locking key is configured to be slid to a locking position and keep the locking-releasing button from moving as the lever and in a locked state when the elastically expandable baton is in the short-baton state; and be slid to an unlocking position and keep the locking-releasing button in an unlocked state where the lever movement of the locking-releasing button is not blocked by the safety locking key, so that the locking-releasing button can be pressed to release the impact head through lever movement. Accordingly, the elastically expandable baton when not in use can be always kept in a s safe short-baton state, which facilitates storage and carry, and when a user faced with an emergency intends to use the elastically expandable baton, he or she only has to push the safety locking key by a finger to press it against the other end of the slide groove, and the locking-releasing button will be stably kept in a releasable state in which the impact head can be swiftly released by pressing the release key of the locking-releasing button with a finger. As a result, the impact head, as being pushed by the strong elastic force accumulated in the coil spring that has been compressed to the shortest state, is instantaneously displaced outward along with the inner tube and the middle tube, and springs out of the outer tube, making the elastically expandable baton to expand instantly into a long-baton state allowing attack on an enemy as well as self-defense, which greatly increases the convenience and safety of use and operation of the elastically expandable baton. Accordingly, as the safety locking key is directly embedded in the locking-releasing key, the assembling efficiency of the elastically expandable baton can be effectively increased on the premise of lowest cost-benefit ratio.

In certain embodiments, the locking-releasing button is pivotally connected to the positioning portion through a pivot shaft. The pivot shaft is located between the two ends of the locking-releasing button. The locking-releasing button includes a release key at one of the two ends of the locking-releasing button, and a restoring spring. The restoring spring has two ends configured to abut the release key and the positioning portion, respectively, and is configured to push the release key and keep the locking hook at a position where the locking hook is engaged with an engaging groove of the impact head that is at the periphery of the impact head. The locking hook is at the other one of the two ends of the locking-releasing button, and configured to correspond to the front end of the outermost hollow tube of the elastically expandable baton and be engaged with the engaging groove of the impact head when the elastically expandable baton is in the short-baton state.

In certain embodiments, a height-difference portion is provided at the front end of the slide groove. The safety locking key has a locking block. When the safety locking key is at the locking position, the locking block is located on or above the height-difference portion.

In certain embodiments, the positioning portion is formed with two grooves arranged along the front-rear direction. The safety locking key has a deformable portion configured to be fitted in a rear one of the two grooves of the positioning portion when the safety locking key is at the unlocking position, and be fitted in the front one of the two grooves of the positioning portion when the safety locking key is at the locking position.

In certain embodiments, the deformable portion includes a spring and a ball. The spring has two ends configured to press against the safety locking key and the ball, respectively, and configured to push the ball along a direction away from the safety locking key. The ball is configured to be fitted in the rear one of the two grooves when the safety locking key is at the unlocking position, and be fitted in the front one of the two grooves when the safety locking key is at the locking position.

In certain embodiments, the positioning portion has extension plates opposite to each other, each configured to be placed into the slide groove and having a pivot hole for being passed with the pivot shaft. The safety locking key has a slot configured to allow the pivot shaft to be passed therethrough and be displaced back and forth therein. The end-to-end length of the slot is greater than the diameter of the pivot shaft.

In certain embodiments, at least one of the extension plates is formed with at least one position-limiting hole. The safety locking key is provided with at least one position-limiting block configured to be placed in the position-limiting hole. The position-limiting block has a length in a front-rear direction that is less than the hole diameter of the position-limiting hole, and is displaceable in the position-limiting hole.

In certain embodiments, the locking-releasing button is formed with at least one position-limiting groove on an inner wall of the slide groove. The rear end of the position-limiting groove is closer to the top surface of the locking-releasing button than the front end of the position-limiting groove is. The length of the position-limiting groove in the front-rear direction is greater than the length of the position-limiting block in the front-rear direction so that the position-limiting block is displaceable in the position-limiting hole.

In certain embodiments, the entirety or a part of the positioning portion is integrally formed with the outermost hollow tube of the elastically expandable baton.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
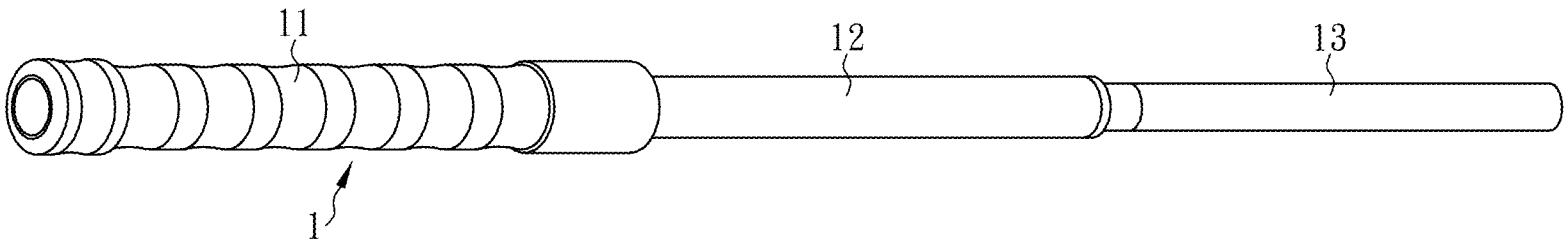
FIG. 1 (Prior Art)
FIG. 1 is a schematic diagram of a conventional swinging-type expandable baton.
Figure 2:
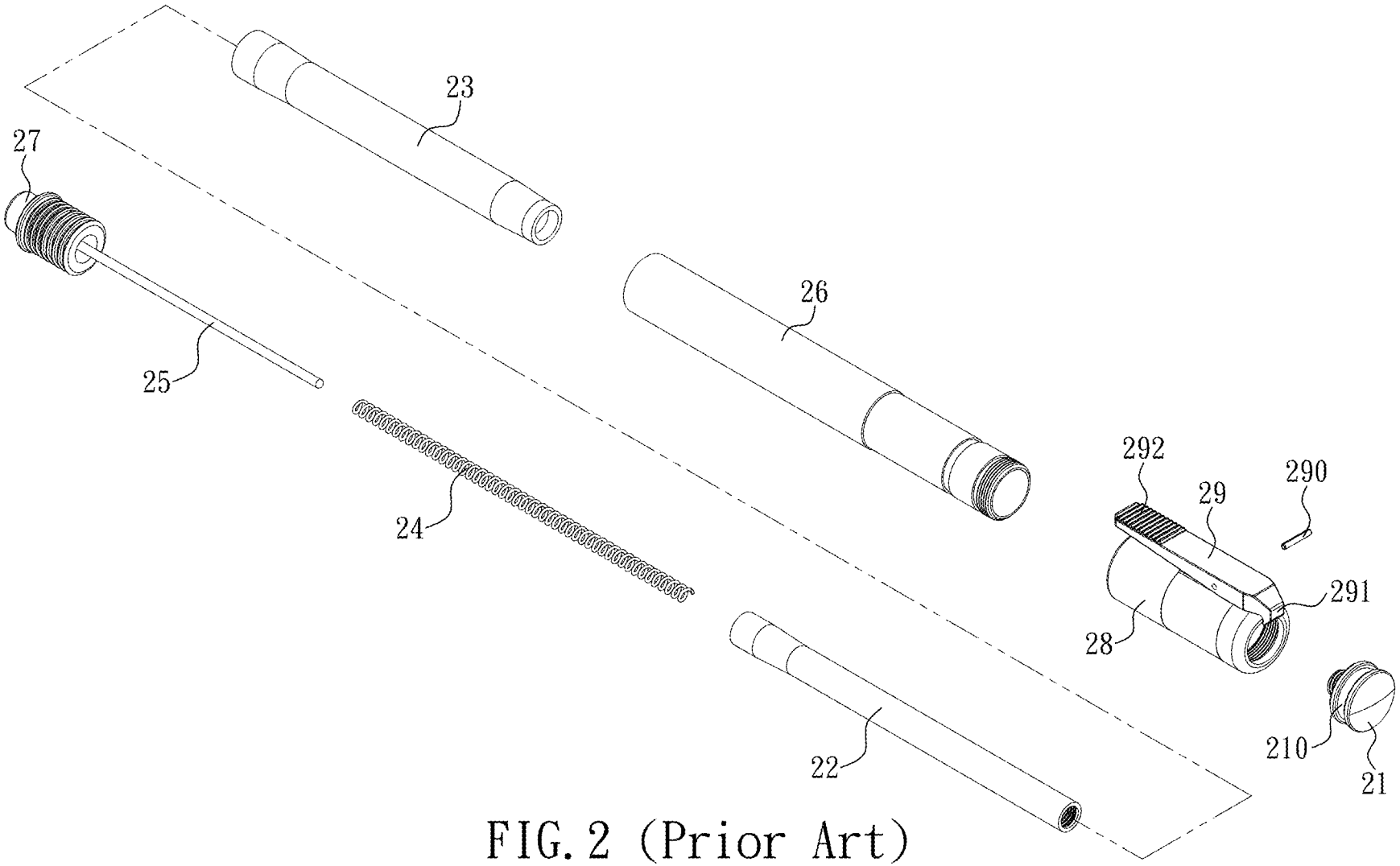
FIG. 2 (Prior Art)
FIG. 2 is an exploded view of a conventional elastically expandable baton.
Figure 3:
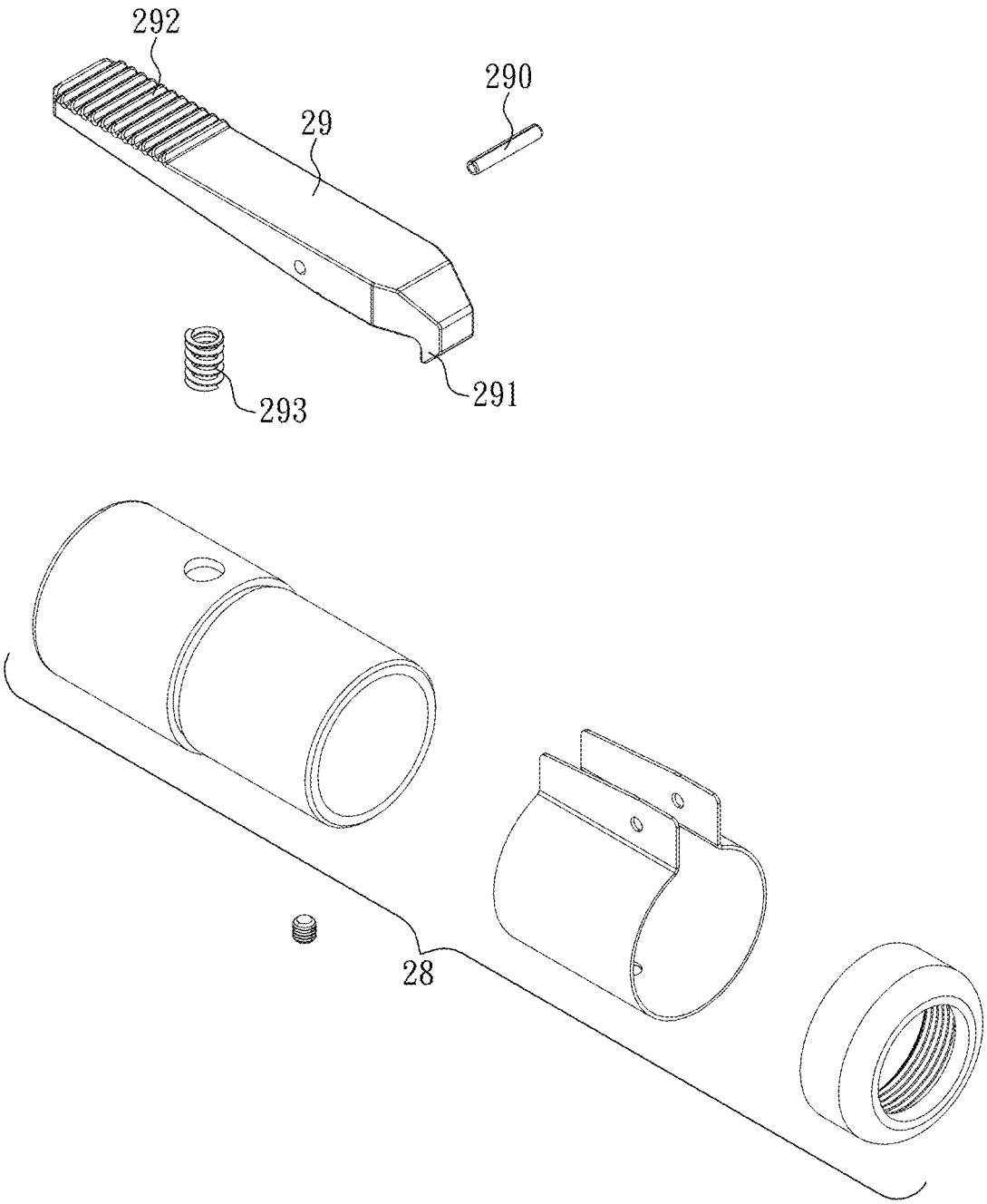
FIG. 3 (Prior Art)
FIG. 3 is an exploded view of a part of a conventional elastically expandable baton.
Figure 4:
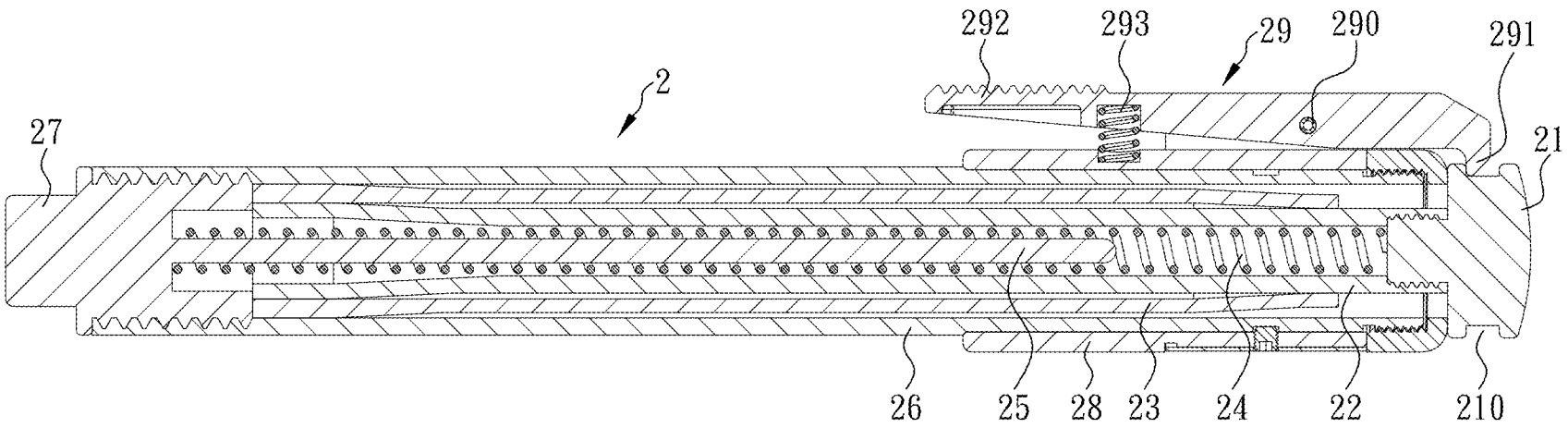
FIG. 4 (Prior Art)
FIG. 4 is a longitudinal cross-section view of a conventional elastically expandable baton.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The accompanying drawings are schematic and may not have been drawn to scale. The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, materials, objects, or the like, which are for distinguishing one component/material/object from another one only, and are not intended to, nor should be construed to impose any substantive limitations on the components, materials, objects, or the like. Directional terms (e.g., "front", "rear", "left", "right", "upper/top" and/or "lower/bottom") are explanatory only and are not intended to be restrictive of the scope of the present disclosure.

Figure 5:
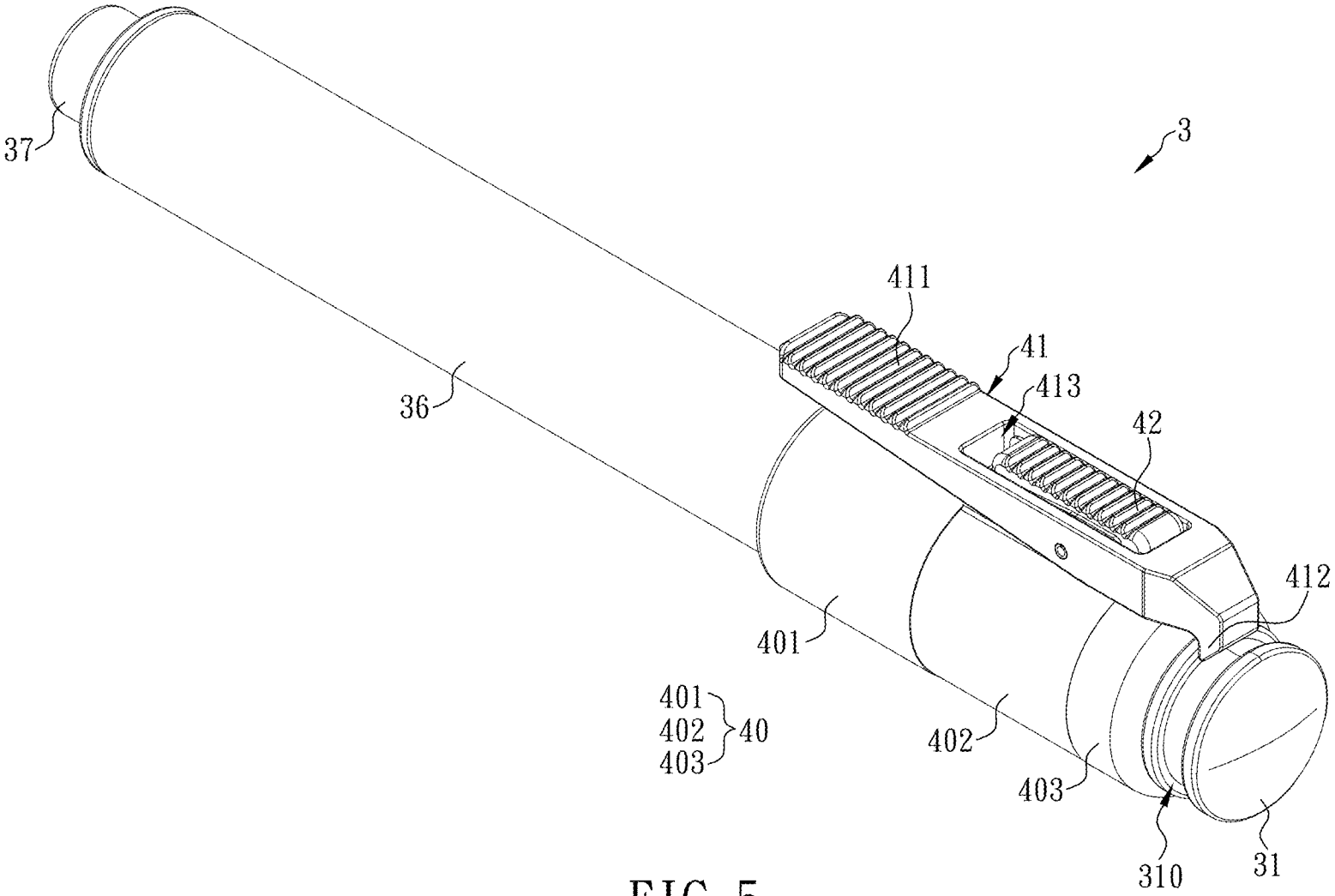
FIG. 5 is a perspective view of an elastically expandable baton in a short-baton state according to certain embodiments of the present disclosure.
Figure 6:
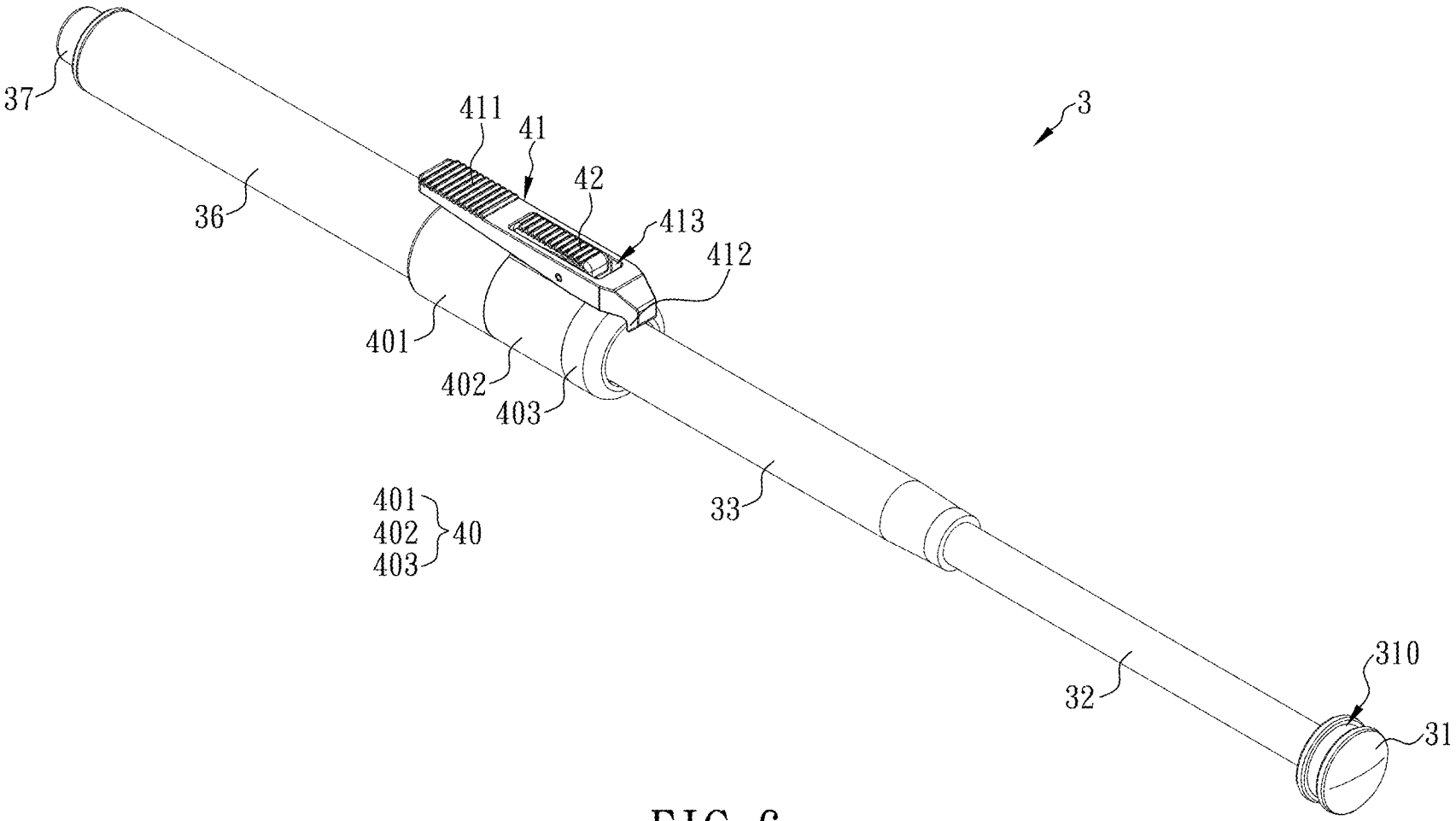
FIG. 6 is a perspective view of an elastically expandable baton in a long-baton state according to certain embodiments of the present disclosure.
Figure 7:
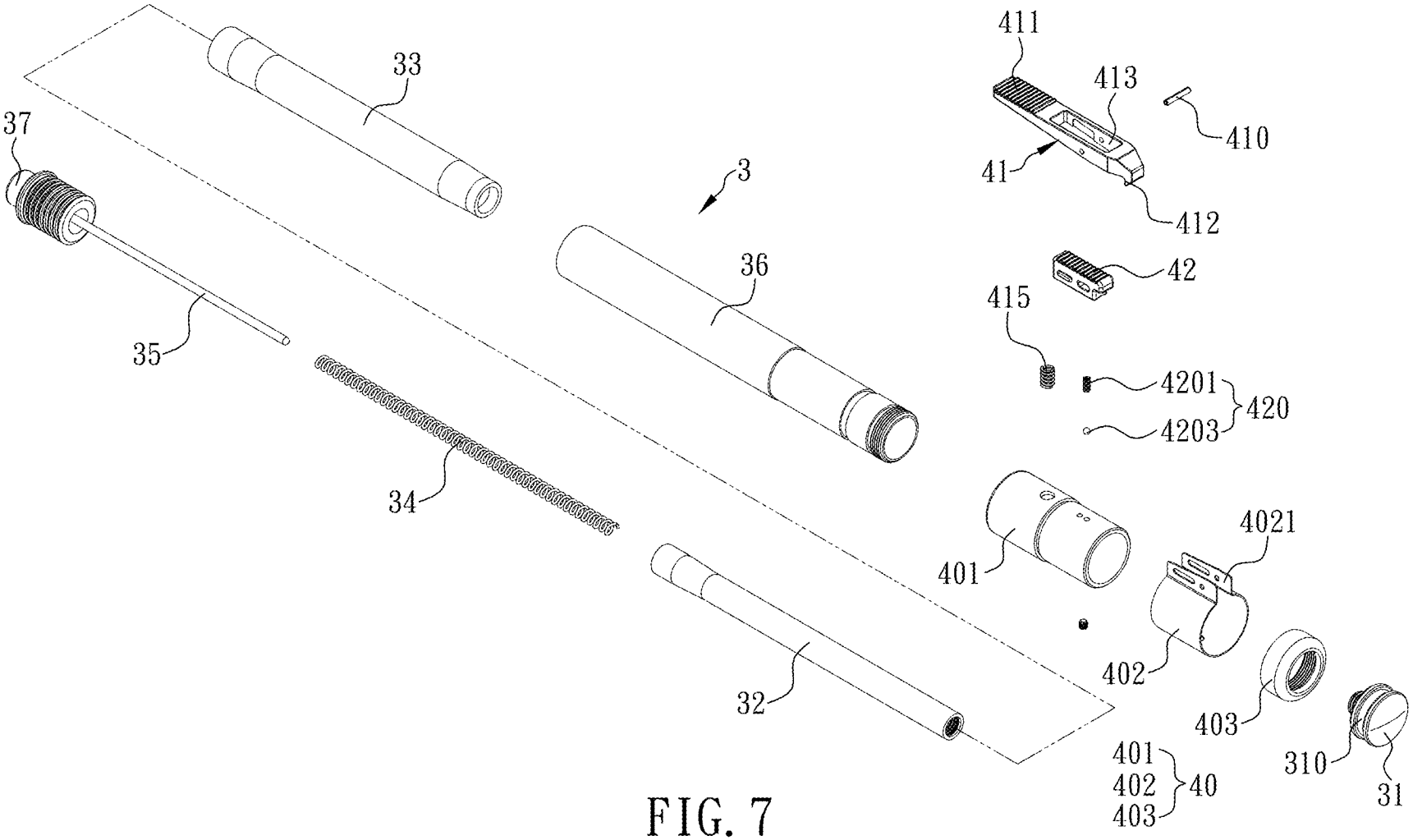
FIG. 7 is an exploded view of an elastically expandable baton according to certain embodiments of the present disclosure.

In view of the fact that the release key of a conventional elastically expandable baton is very likely to be pressed by accident such that not only will the impact head, the inner tube, and the middle tube of the baton spring out instantaneously, but also the great impact force generated by the springing action may hurt the users themselves or a nearby person or object, as a result of years of practical experience and professional knowledge, repeated tests, continual research and development, and an evaluation of various feasibilities in practice, a safety locking mechanism for an elastically expandable baton is provided in the present disclosure, which is easier to produce and easier to assemble and can effectively improve the production efficiency of an elastically expandable baton and greatly enhance the convenience and safety of use and operation of an elastically expandable baton. The present disclosure provides a safety locking mechanism for an elastically expandable baton. The safety locking mechanism is applicable to an elastically expandable baton 3 and includes a positioning portion 40, a locking-releasing button 41, and a safety locking key 42. Referring to FIG. 5 to FIG. 7, the elastically expandable baton 3 can be collapsed into a short-baton state (as shown in FIG. 5) or expanded into a long-baton state (as shown in FIG. 6). The safety locking mechanism is configured to keep the elastically expandable baton 3 in the short-baton state.

To facilitate description of the operation of the safety locking mechanism, the basic structure of the elastically expandable baton 3 is hereby described first, the lower right corner of FIG. 7 is defined as facing the front side of an element, the upper left corner of FIG. 7 is defined as facing the rear side of an element, the upper right corner of FIG. 7 is defined as facing the right side of an element, the lower left corner of FIG. 7 is defined as facing the left side of an element, the top edge of FIG. 7 as facing the upper side (the top side) of an element, and the bottom edge of FIG. 7 as facing the lower side (the bottom side) of an element. As shown in FIG. 7, the elastically expandable baton 3 includes an impact head 31, an inner tube 32, a middle tube 33, a coil spring 34, a spring mounting rod 35, an outer tube 36, and a cap 37. The inner tube 32, the middle tube 33, and the outer tube 36 are configured as hollow tubes and can be sequentially sleevingly connected to each other. In certain embodiments, however, according to product demands, the number of the hollow tubes used in the elastically expandable baton 3 can be two or four or more than four.

With continued reference to FIG. 7, the rear end of the outer tube 36 and the cap 37 can be locked to each other. The outer diameter of the rear end of the middle tube 33 is greater than the inner diameter of the front end of the outer tube 36, and the outer diameter of the other portion of the middle tube 33 (i.e., the portion of the middle tube 33 that excludes the rear end of the middle tube 33) is less than the inner diameter of the outer tube 36 so that the middle tube 33 can be not only retracted into the outer tube 36, but also extended out of the outer tube 36 through the front end of the outer tube 36 until the rear end of the middle tube 33 is engaged with the front end of the outer tube 36. The outer diameter of the rear end of the inner tube 32 is greater than the inner diameter of the front end of the middle tube 33, and the outer diameter of the other portion of the inner tube 32 (i.e., the portion of the inner tube 32 that excludes the rear end of the inner tube 32) is less than the inner diameter of the middle tube 33 so that the inner tube 32 can be not only retracted into the middle tube 33, but also extended out of the middle tube 33 through the front end of the middle tube 33 until the rear end of the inner tube 32 is engaged with the front end of the middle tube 33. In certain embodiments, there can be a plurality of middle tubes 33, and the tube diameters (inner diameters and outer diameters) of each two adjacent middle tubes 33 vary in a way similar to that of the aforesaid inner tube 32 and the aforesaid middle tube 33 (or that of the aforesaid middle tube 33 and outer tube 36) so that the plural middle tubes 33 can be retracted and extended with respect to one another.

As shown in FIG. 5 to FIG. 7, through the different inner and outer diameters of the inner tube 32, middle tube 33, and outer tube 36, the inner tube 32 can be retracted into the middle tube 33 and the middle tube 33 can be retracted into the outer tube 36 such that the elastically expandable baton 3 can be collapsed into a safe short-baton state (see FIG. 5), in which the elastically expandable baton 3 can be carried or stored with ease. Further, each two adjacent ones of the inner tube 32, middle tube 33, and outer tube 36 of the elastically expandable baton 3 can be extended with respect to, and engaged with, each other such that the elastically expandable baton 3 is expanded into the long-baton state (see FIG. 6), in which the elastically expandable baton 3 can be used to attack an enemy as well as for self-defense. The impact head 31 can be locked to, and located outside, the front end of the inner tube 32, and the outer diameter of the impact head 31 is greater than the inner diameter of the front end of the outer tube 36 so that the impact head 31 remains exposed when the elastically expandable baton 3 is in the short-baton state. The rear end of the spring mounting rod 35 can be fixed to the inner side of the cap 37, and the front end of the spring mounting rod 35 can be put into the inner tube 32 through the rear end of the inner tube 32. The coil spring 34 can be mounted around the spring mounting rod 35. In certain embodiments, the rear end of the coil spring 34 is configured to abut the cap 37, and the front end of the coil spring 34 is configured to abut the impact head 31 so that the coil spring 34 is compressed by the impact head 31 when the elastically expandable baton 3 is in the short-baton state. In certain embodiments, however, each of the two ends of the coil spring 34 can abut another element of the elastically expandable baton 3, for example, an inner side of the outer tube 36 or an inner side of the inner tube 32, as long as the coil spring 34 is compressed while the elastically expandable baton 3 is in the short-baton state, and the force stored in the coil spring 34 while the baton is in the short-baton state is sufficient to push the inner tube 32 outward.

Figure 8:
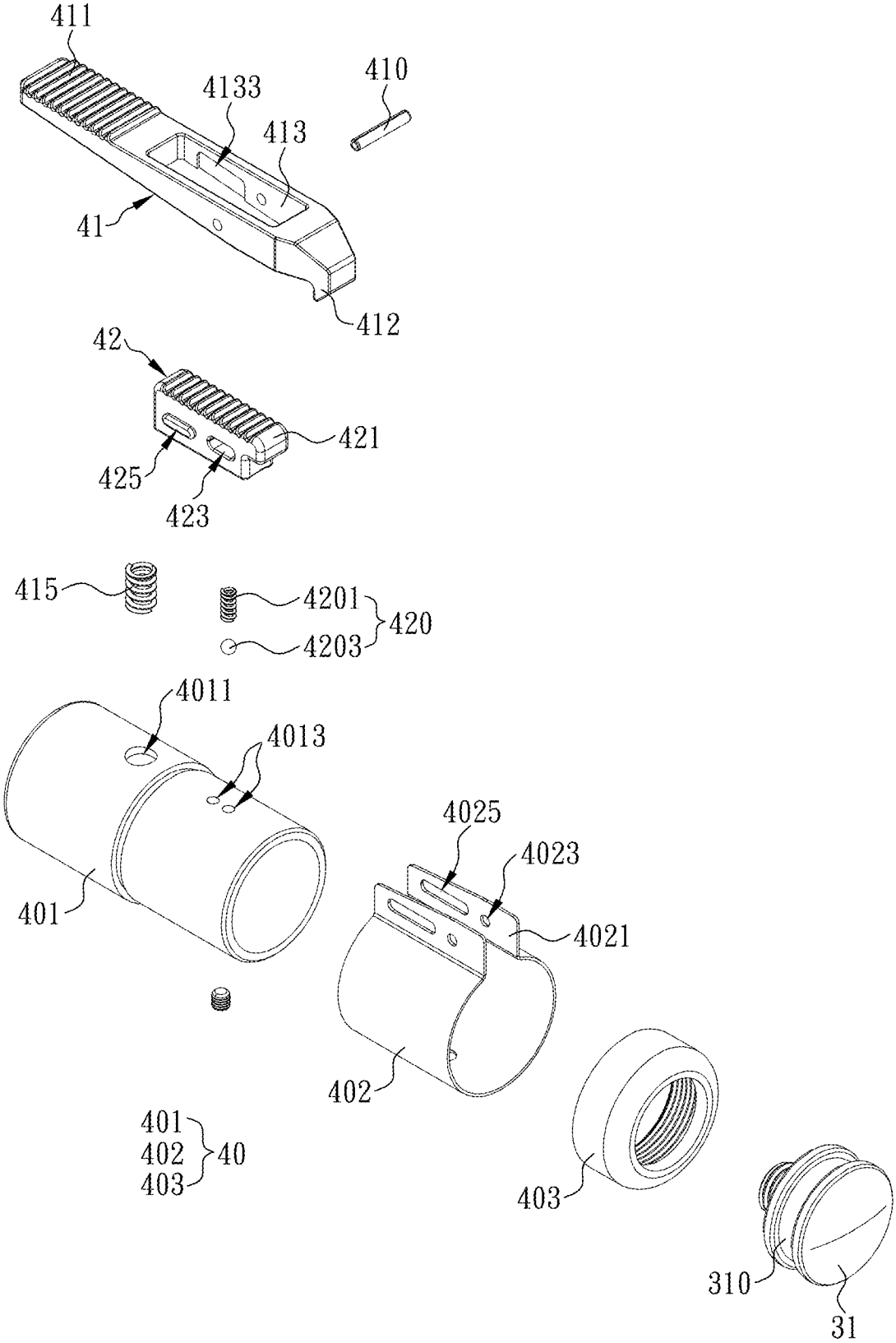
FIG. 8 is an exploded view of a part of an elastically expandable baton according to certain embodiments of the present disclosure.

As shown in FIG. 7 and FIG. 8, the positioning portion 40 can be locked to the outer periphery of the outer tube 36 at a position adjacent to the front end of the outer tube 36. In certain embodiments, the positioning portion 40 includes a first element 401, a second element 402, and a third element 403. Each of the first element 401, the second element 402, and the third element 403 has a substantially tubular configuration. The substantially tubular configuration includes a tubular structure without an open space in the periphery (for example, the first element 401 and the third element 403), a tubular structure with an open space in the periphery (for example, the second element 402), etc. The first element 401, the second element 402, and the third element 403 are configured to be sleevingly mounted around the outer tube 36 sequentially. As shown in FIG. 5, the first element 401 is closer to the rear end of the outer tube 36 than the second and third elements 402 and 403 are and is formed with a spring positioning groove 4011 (see FIG. 8), the third element 403 is closer to the front end of the outer tube 36 than the first and second elements 401 and 402 are, and the second element 402 is located between the first and third elements 401 and 403 and is provided with extension plates 4021 opposite to each other (see FIG. 7 and FIG. 8). The extension plates 4021 are spaced apart from each other, and extend along a direction away from the outer tube 36. Each extension plate 4021 is formed with a pivot hole 4023, and the pivot holes 4023 face each other. In certain embodiments, the entirety or a part of the first element 401, the second element 402 and the third element 403 can be integrally formed with the outer tube 36. In certain embodiments, the structures of the first element 401, the second element 402, and the third element 403 can be formed on the outer tube 36 to reduce the total number of the elements of the elastically expandable baton 3.

As shown in FIG. 7 and FIG. 8, the locking-releasing button 41 includes a release key 411, a locking hook 412, and a restoring spring 415. The locking-releasing button 41 is provided with, and vertically penetrated by, a slide groove 413, and the extension plates 4021 of the second element 402 are configured to be placed into the slide groove 413 such that each extension plate 4021 lies against or is adjacent to a corresponding one of the inner walls of the slide groove 413 that are opposite to each other. A pivot shaft 410 can be passed through the locking-releasing button 41 and located in the pivot holes 4023 of the extension plates 4021 so that the locking-releasing button 41 is pivotally connected to the outer tube 36, thereby positioning the locking-releasing button 41 on the outer tube 36. However, the present disclosure is not limited thereto. In certain embodiments, each extension plate 4021 can lie against an outer lateral surface of the locking-releasing button 41, and the pivot shaft 410 can be passed through the locking-releasing button 41 and located in the pivot holes 4023 of the extension plates 4021. In certain embodiments, the pivot shaft 410 is not an independent element but integrally formed with the locking-releasing button 41 and configured to be placed into the pivot holes 4023.

With continued reference to FIG. 7 and FIG. 8, the release key 411 is at the rear end of the locking-releasing button 41, the locking hook 412 is at the front end of the locking-releasing button 41, and the pivot shaft 410 can be located between the two ends of the locking-releasing button 41 so that the locking-releasing button 41 can be rotated about an axis defined by the pivot shaft 410 and accordingly move as a lever. Therefore, when the release key 411 is moved toward the outer tube 36, the locking hook 412 will be moved away from the outer tube 36, and when the release key 411 is moved away from the outer tube 36, the locking hook 412 will be moved toward the outer tube 36.

Referring to FIG. 7 to FIG. 10, the top end of the restoring spring 415 can be fixed on the locking-releasing button 41, and the bottom end of the restoring spring 415 can be placed into and be fixed in the spring positioning groove 4011. The restoring spring 415 is configured to apply a force to the rear end of the locking-releasing button 41 such that the release key 411 can be moved away from the outer tube 36 by the force. Accordingly, a user only has to press the release key 411 and overcome the force of the restoring spring 415, and the release key 411 will be moved toward the outer tube 36, with the locking hook 412 moved away from the outer tube 36. When the user stops pressing the release key 411, the restoring spring 415 will push the release key 411 away from the outer tube 36 such that the locking hook 412 is moved toward the outer tube 36.

With continued reference to FIG. 7 to FIG. 10, the safety locking key 42 is configured to be mounted to the locking-releasing button 41 and be slidable from an unlocking position (e.g., the rear end of the slide groove 413) to a locking position (e.g. the front end of the slide groove 413). When at the unlocking position, the safety locking key 42 does not affect the locking-releasing button 41's movement as a lever, and accordingly the locking-releasing button 41 is in the unlocked state. When the safety locking key 42 is at the locking position, the locking-releasing button 41 cannot move as a lever and is hence in the locked state, and the release key 411 cannot be moved by a user's press. The safety locking key 42 further has a deformable portion 420. In certain embodiments, the deformable portion 420 includes a spring 4201 and a ball 4203. The two ends of the spring 4201 press against the safety locking key 42 and the ball 4203, respectively, and the spring 4201 pushes the ball 4203 along a direction away from the safety locking key 42. The first element 401 of the positioning portion 40 can be formed with two grooves 4013 that are arranged along a front-rear direction. When the safety locking key 42 is at the unlocking position, the ball 4203 is fitted in the rear groove 4013, and when the safety locking key 42 is at the locking position, the ball 4203 is fitted in the front groove 4013. Accordingly, the deformable portion 420 not only allows the safety locking key 42 to be secured at either of the unlocking position and the locking position, but also makes it possible for a user to know, from the tactile feedback of the operation of the deformable portion 420, whether the safety locking key 42 has been pushed to the unlocking position or the locking position. However, in certain embodiments, the deformable portion 420 can adopt other structures, as long as the deformable portion 420 can deform to achieve the afore-referenced effects.

In certain embodiments, with continued reference to FIG. 7 to FIG. 10, a height-difference portion 4131 is provided at the front end of the slide groove 413, and the safety locking key 42 has a locking block 421. When the safety locking key 42 is at the locking position, the locking block 421 is located on or above the height-difference portion 4131 such that when the release key 411 is pressed, the height-difference portion 4131 will be blocked by the locking block 421 to become unable to move, thereby preventing the locking-releasing button 41 from moving as a lever. When the safety locking key 42 is at the unlocking position, the locking block 421 is no longer on or above the height-difference portion 4131, and accordingly when the release key 411 is pressed, the height-difference portion 4131 will not be blocked by the locking block 421, that is, the locking-releasing button 41 is able to move as a lever. In certain embodiments, however, the safety locking key 42 can adopt other locking mechanisms, and is not limited to the afore-referenced structure, as long as the safety locking key 42 can be moved to allow the locking-releasing button 41 to be in an unlocked state or a locked state.

Figure 11:
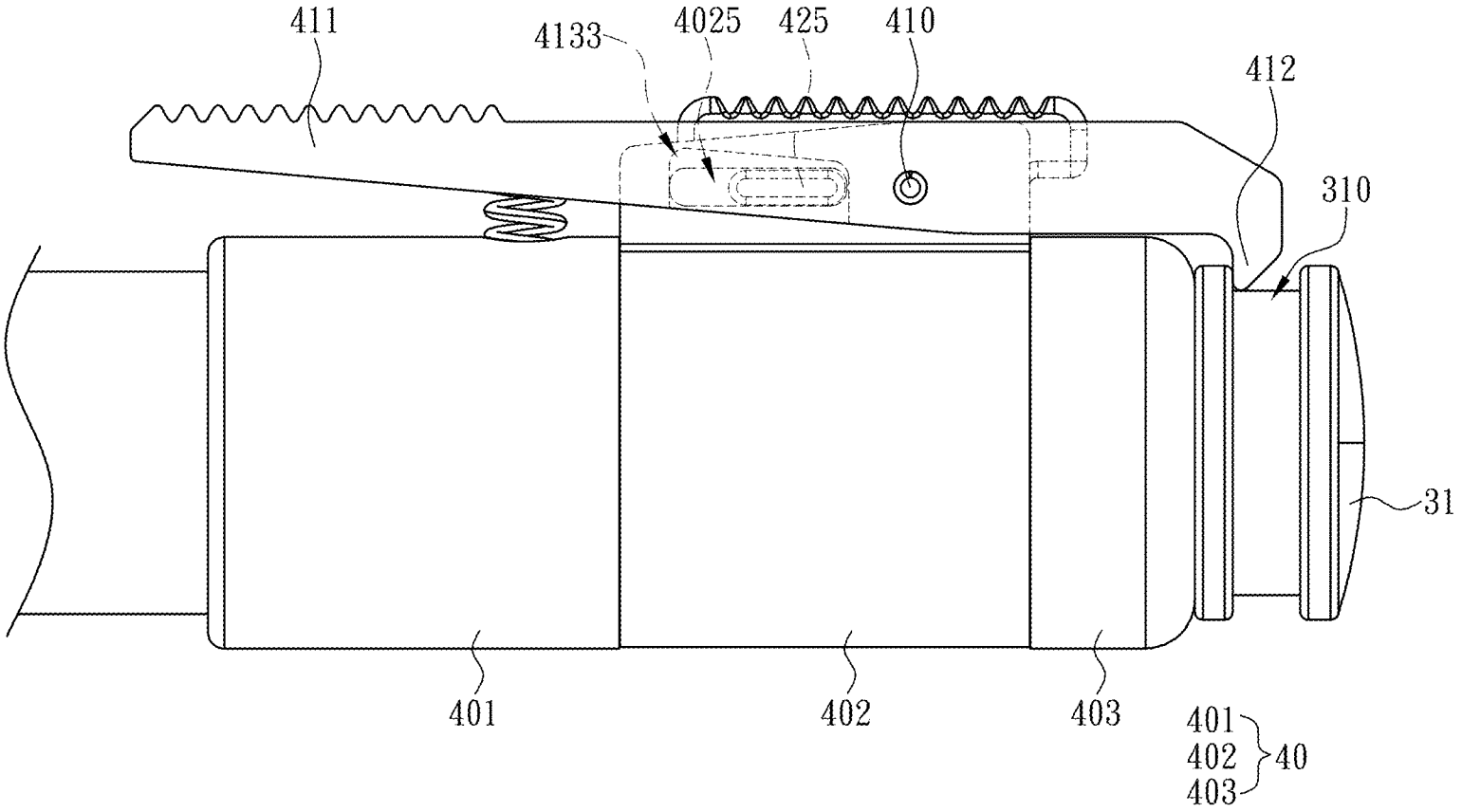
FIG. 11 is a side view of a part of an elastically expandable baton according to certain embodiments of the present disclosure, in which the locking-releasing button is shown in broken line.

In certain embodiments, with continued reference to FIG. 7 to FIG. 10, the safety locking key 42 has a slot 423 configured to allow the pivot shaft 410 to be passed therethrough. The end-to-end length of the slot 423 is greater than the diameter of the pivot shaft 410 so that the pivot shaft 410 can be displaced back and forth in the slot 423, thereby allowing the safety locking key 42 to be freely moved between the unlocking position and the locking position. The design of the slot 423 and the pivot shaft 410 allows the safety locking key 42 to be securely positioned in the locking-releasing button 41. However, the present disclosure is not limited thereto. In certain embodiments, the safety locking key 42 can be positioned in the locking-releasing button 41 through other structures that are sufficiently capable of doing so. In addition, to prevent the safety locking key 42 from being rotated out of the slide groove 413 by an external force, the safety locking key 42 in certain embodiments is further provided with at least one position-limiting block 425, and the second element 402 is formed with at least one position-limiting hole 4025. The length of the position-limiting block 425 in the front-rear direction is less than the hole diameter of the position-limiting hole 4025 in the front-rear direction so that the position-limiting block 425 can be displaced in the position-limiting hole 4025. The hole wall of the position-limiting hole 4025 can produce a blocking effect on the position-limiting block 425 and thereby prevent the position-limiting block 425 from separating from the position-limiting hole 4025; as a result, the safety locking key 42 is kept from rotating to a great extent about an axis defined by the pivot shaft 410, and from rotating out of the slide groove 413, which if happening will compromise the ability of the safety locking key 42 to lock the locking-releasing button 41. In certain embodiments, referring to FIG. 11, to ensure that the safety locking key 42 is securely positioned in the slide groove 413, the locking-releasing button 41 can be further formed with at least one position-limiting groove 4133 on the inner wall of the slide groove 413. The length of the position-limiting groove 4133 in the front-rear direction is greater than the length of the position-limiting block 425 in the front-rear direction so that the position-limiting block 425 can be displaced in the position-limiting hole 4025. Also, the rear end of the position-limiting groove 4133 is closer to the top surface of the locking-releasing button than the front end of the position-limiting groove 4133 is, so as not to affect the movement of the locking-releasing button 41 as a lever.

Figure 9:
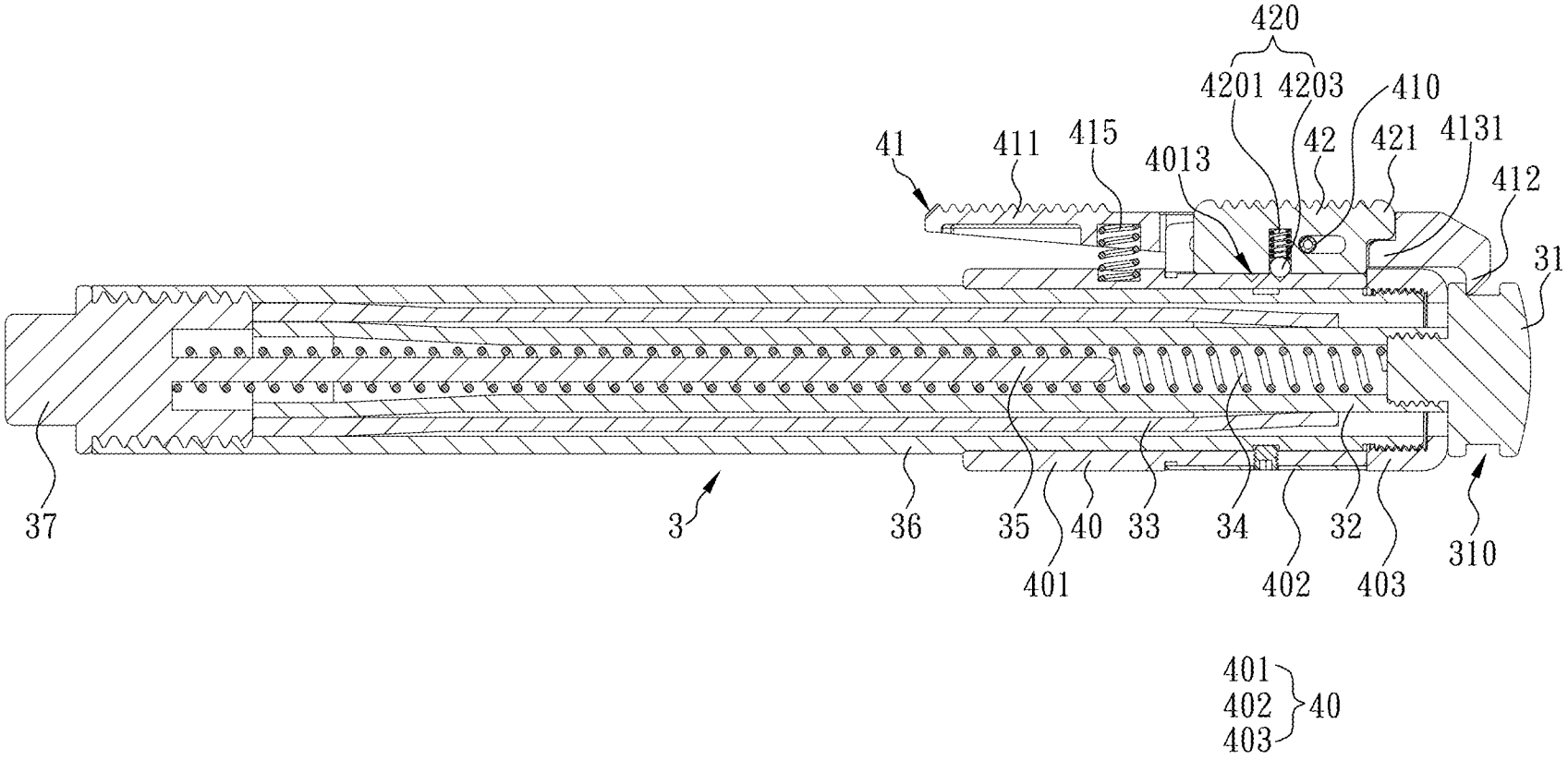
FIG. 9 is a longitudinal cross-section view of an assembled part of an elastically expandable baton in a locked state according to certain embodiments of the present disclosure.
Figure 10:
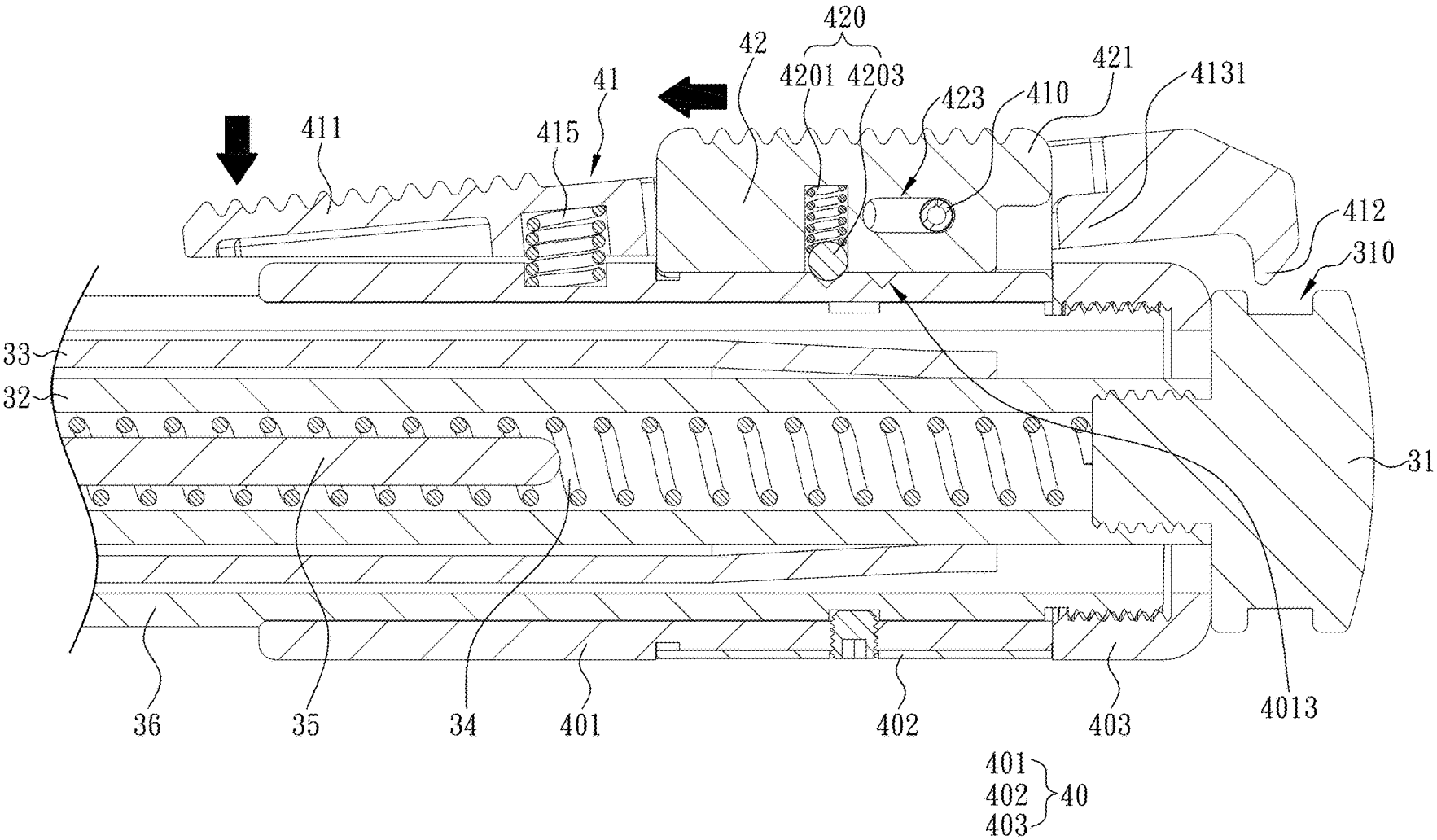
FIG. 10 is a cross-section view of a part of an elastically expandable baton in an unlocked state according to certain embodiments of the present disclosure.

Referring to FIG. 7 to FIG. 10, once the elastically expandable baton 3 is collapsed into the short-baton state, the locking hook 412 is precisely engaged with an engaging groove 310 concavely formed on the periphery of the impact head 31 (see FIG. 9). Meanwhile, the force applied by the restoring spring 415 ensures that in the absence of an external force, the release key 411 is moved along a direction away from the outer tube 36, thereby keeping the locking hook 412 at a position where the locking hook 412 is engaged with the engaging groove 310 on the periphery of the impact head 31 to lock the impact head 31 securely in place. When the user subsequently pushes the safety locking key 42 to the locking position and thereby disposes the locking block 421 on or above the height-difference portion 4131, the locking-releasing button 41 is brought into the locked state. Accordingly, the positioning portion 40, the locking-releasing button 41, and the safety locking key 42 form a safety locking mechanism in which the safety locking key 42 can ensure that when the user or an external object presses the release key 411 inadvertently, the locking-releasing button 41 will be kept from moving as a lever, thereby allowing the elastically expandable baton 3 to stay in the short-baton state, where the baton can be easily carried, stored, or worn by the user. When the user is faced with an emergency and desires to use the elastically expandable baton 3, the safety locking key 42 can be pushed to the unlocking position (as indicated by the right-hand-side thick arrow in FIG. 10) so that the locking block 421 is moved away from its position on or above the height-difference portion 4131, thereby bringing the locking-releasing button 41 into the unlocked state. Afterwards, the user only has to press the release key 411 with a finger (e.g., a thumb or an index finger) (as indicated by the left-hand-side thick arrow in FIG. 10), and the locking-releasing button 41 will move as a lever and make the locking hook 412 release the impact head 31 (i.e., disengage the locking hook 412 from the engaging groove 310). The impact head 31, therefore, will be pushed and displaced outward by the great elastic force stored in the coil spring 34, with the inner tube 32 and the middle tube 33 moving along with the impact head 31 and springing out of the outer tube 36 at once until the elastically expandable baton 3 is expanded into the long-baton state, which is suitable for attacking an enemy as well as for self-defense.

With continued reference to FIG. 7 to FIG. 10, as the safety locking key 42 is embedded directly in the locking-releasing button 41, the assembly efficiency of the elastically expandable baton 3 can be effectively increased on the premise of lowest cost-benefit ratio. A user only has to push the safety locking key 42, and the locking-releasing button 41 will rapidly perform its functions as a three-in-one button, which include allowing the elastically expandable baton 3 to expand into the long-baton state, locking the elastically expandable baton 3 in the short-baton state, and providing safety against movement of the locking-releasing button 41 upon an inadvertent press. Accordingly, the convenience and safety of use of the elastically expandable baton 3 are both enhanced. The safety locking mechanism in the present disclosure not only renders the composition of each element simpler than in the prior art, but also ensures that the elements of the locking-releasing button 41 can work with one another in a more straightforward, smoother, and more balanced way.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A safety locking mechanism applicable to an elastically expandable baton and comprising:

a positioning portion configured to be arranged at an outer periphery of an outermost hollow tube of the elastically expandable baton at a position adjacent to a front end of the outermost hollow tube;

a locking-releasing button pivotally connectable to the positioning portion, having a locking hook, a slide groove and two ends configured to move as a lever on the positioning portion, and configured to:

lock an impact head of the elastically expandable baton through the locking hook and keep the elastically expandable baton in a short-baton state; and release the impact head of the elastically expandable baton through a lever movement when being pressed and allow the elastically expandable baton to be expanded into a long-baton state; and a safety locking key mountable to and bidirectionally slidable in the slide groove of the locking-releasing button, and configured to be slid to a locking position and keep the locking-releasing button from moving as the lever and in a locked state when the elastically expandable baton is in the short-baton state, and be slid to an unlocking position and keep the locking-releasing button in an unlocked state where the lever movement of the locking-releasing button is not blocked by the safety locking key.

2. The safety locking mechanism according to claim 1, wherein the locking-releasing button is pivotally connected to the positioning portion through a pivot shaft; the pivot shaft is located between the two ends of the locking-releasing button; the locking-releasing button includes a release key at one of the two ends of the locking-releasing button, and a restoring spring having two ends configured to abut the release key and the positioning portion, respectively, and configured to push the release key and keep the locking hook at a position where the locking hook is engaged with an engaging groove of the impact head that is at the periphery of the impact head; and the locking hook is at the other one of the two ends of the locking-releasing button, and configured to correspond to the front end of the outermost hollow tube of the elastically expandable baton and be engaged with the engaging groove of the impact head when the elastically expandable baton is in the short-baton state.

3. The safety locking mechanism according to claim 1, wherein a height-difference portion is provided at a front end of the slide groove, the safety locking key has a locking block, and when the safety locking key is at the locking position, the locking block is located on or above the height-difference portion.

4. The safety locking mechanism according to claim 1, wherein the positioning portion is formed with two grooves arranged along a front-rear direction, the safety locking key has a deformable portion configured to be fitted in a rear one of the two grooves of the positioning portion when the safety locking key is at the unlocking position, and be fitted in the front one of the two grooves of the positioning portion when the safety locking key is at the locking position.

5. The safety locking mechanism according to claim 4, wherein the deformable portion includes a spring and a ball; the spring has two ends configured to press against the safety locking key and the ball, respectively, and configured to push the ball along a direction away from the safety locking key; and the ball is configured to be fitted in the rear one of the two grooves when the safety locking key is at the unlocking position, and be fitted in the front one of the two grooves when the safety locking key is at the locking position.

6. The safety locking mechanism according to claim 2, wherein the positioning portion has extension plates opposite to each other, each configured to be placed into the slide groove and having a pivot hole for being passed with the pivot shaft; and the safety locking key has a slot configured to allow the pivot shaft to be passed therethrough and be displaced back and forth therein, wherein an end-to-end length of the slot is greater than a diameter of the pivot shaft.

7. The safety locking mechanism according to claim 6, wherein at least one of the extension plates is formed with at least one position-limiting hole; the safety locking key is provided with at least one position-limiting block configured to be placed in the position-limiting hole; and the position-limiting block has a length in a front-rear direction that is less than a hole diameter of the position-limiting hole, and is displaceable in the position-limiting hole.

8. The safety locking mechanism according to claim 7, wherein the locking-releasing button is formed with at least one position-limiting groove on an inner wall of the slide groove, a rear end of the position-limiting groove is closer to a top surface of the locking-releasing button than a front end of the position-limiting groove is, and a length of the position-limiting groove in the front-rear direction is greater than the length of the position-limiting block in the front-rear direction so that the position-limiting block is displaceable in the position-limiting hole.

9. The safety locking mechanism according to claim 1, wherein the entirety or a part of the positioning portion is integrally formed with the outermost hollow tube of the elastically expandable baton.

* * * * *